United States Patent [19]

Bommersheim et al.

[11] 4,141,660

[45] Feb. 27, 1979

[54] PRINTER FOR DATA-PROCESSING MACHINE HAVING SINGLE OPERATOR STATION

[75] Inventors: Hans Bommersheim, Brigachtal; Bernhard Hettich, Villingen-Schwenningen; Helmut Keller, Geisingen; Werner Moser; Klaus Tauchert, both of Villingen-Schwenningen, all of Fed. Rep. of Germany

[73] Assignee: Kienzle Apparate GmbH, Villingen, Fed. Rep. of Germany

[21] Appl. No.: 853,573

[22] Filed: Nov. 21, 1977

Related U.S. Application Data

[63] Continuation of Ser. No. 666,231, Mar. 12, 1976, abandoned.

[30] Foreign Application Priority Data

Mar. 19, 1975 [DE] Fed. Rep. of Germany ..... 2511983

[51] Int. Cl.[2] ..... B41J 11/26; B41J 11/58; B41J 29/48

[52] U.S. Cl. ..... 400/124; 400/613.2; 400/616; 400/618; 400/708

[58] Field of Search ..... 197/1 R, 126 R, 126 A, 197/132, 133 R, 127 R, 133 P, 133 F, 134; 227/76, 79, 82, 86; 400/124, 613.2, 616, 693, 708, 618

[56] References Cited

U.S. PATENT DOCUMENTS

| | | | |
|---|---|---|---|
| 2,911,905 | 11/1959 | Marvin et al. | 226/82 X |
| 3,334,722 | 8/1967 | Bernard | 197/133 R |
| 3,586,149 | 6/1971 | Miller | 197/133 R |
| 3,707,215 | 12/1972 | Familant | 197/133 R |
| 3,746,142 | 7/1973 | Hepp et al. | 197/133 R |

FOREIGN PATENT DOCUMENTS

| | | | |
|---|---|---|---|
| 2428354 | 1/1975 | Fed. Rep. of Germany | 197/1 R |

OTHER PUBLICATIONS

IBM Tech. Disc. Bulletin, D. W. Reed, vol. 1, No. 6, Apr. 1959, p. 3.

*Primary Examiner*—Paul T. Sewell
*Attorney, Agent, or Firm*—Toren, McGeady and Stanger

[57] ABSTRACT

A data-processing machine having a single operator station is provided with a printer comprising a supply holder on the front of the machine next to the operator station for holding a form band, a support on the machine next to the station with an upwardly concave surface, and a receptacle on the back of the machine below the support for catching the printed form band. A guide and a transport device is provided for guiding the band up from the supply holder in the front of the machine, over the surface of the printing station and down to the receptacle. A printing head which is vertically displaceable above the upwardly concave surface is displaceable horizontally along the surface to print the band. A guide slot extending down toward the supply is pivotal between a down position for normal operation of the machine and a raised position for threading a new form band in and a detent is provided for holding it in the up position during reloading. In addition, a magnetic-card printer is provided on the machine adjacent the operator station. Feelers engageable with the band detect when it runs out and emit an alarm for the operator.

7 Claims, 4 Drawing Figures

PRINTER FOR DATA-PROCESSING MACHINE HAVING SINGLE OPERATOR STATION

This is a continuation, of application Ser. No. 666,231, filed Mar. 12, 1976 abandoned.

BACKGROUND OF THE INVENTION

The present invention relates to a printer for a data-processing machine. More particularly this invention concerns such a printer useable in a data-processing machine having a single operator station and set up to print on form bands.

In such a machine the form band or bands are generally pulled out of a pile, printed on, and then loaded into another pile. These bands are usually formed as zig-zag pleated stacks so that at each end the form band can be formed into a neat pile of compact shape. Normally perforations are formed between the individual sheets, so that, if necessary, the printed result can be separated into handy pages.

A data-processing machine with single operator station can include any of the machines used for pre-data-processing operations, as for example billing, bookkeeping, finance-accounting and the like. Such machines are not used in conjunction with external memories or another computer. Thus, such a machine carries out all of its own operations, and is typically referred to as a bookkeeping machine, although it can be readily applied to many other types of tasks, for instance such machines can be used for statistical analysis, in scientific work for recording and analyzing results, for billing and preparing payrolls, for studying operating efficiency in a plant, or calculating profit and the like. Nevertheless such machines are relatively simple in their operation and are self-contained. The necessary types of operations can be programmed right into the machine.

As a rule with such machines the data being processed is continuously printed out. It can also be entered on magnetic cards, and indeed frequently both such permanent records are used. Usually the form band at least is printed right under the operator's eyes. To this end it must be drawn from a supply somewhere into a location easily viewable by the operator sitting at his input station and printed at this station. Thus the band must frequently follow a very circuituous path between the supply and the receptacle in which it eventually terminates. When the band runs out, it is necessary for a rather complicated threading operation to be carried out in order to feed new band in. Furthermore, the feed for the magnetic cards is frequently rather long so that in case one of the cards jams up in the machine, it is necessary to shut down the data-processing operation for the time it takes to clear the problem. With both such systems, form bands and magnetic cards, the longer path the item must follow the greater is the chance of mishap. Furthermore, the longer the feeding path the more drive rollers or the like are needed for the form band in order to hold it tight at the printing location and insure proper spacing between adjacent rows of printing.

It is known to have a system wherein the information is entered first on a so-called control screen. The operator can then verify if the entry is correct and if it is he can push an enter button which causes the machine to transfer this information from the control screen to the printed record. If an error is discovered it is corrected before the enter button is actuated. Thus, with such an arrangement it is not necessary continuously to oversee the printing operation. The only occasions for looking at the actual matter being printed are, for example, after a work break in order to ascertain just where the data-processing operation was stopped.

Even though such systems are known almost invariably the form band is passed through a circuituous path to the printer, and then away from the printer to the receptacle in which it is loaded after printing. Since the printer is almost invariably mounted at eye-level it is typically necessary to have the band run vertically at least in the eye-level printing location and then passed to the receptacle. Thus the form band must be bent back and forth through 180 degrees at least once, increasing the possibility of tearing this form and occasionally leading to separation at the inter-page perforations.

SUMMARY OF THE INVENTION

It is therefore an object of the present invention to provide an improved data-processing machine.

Another object is the provision of a printer which overcomes the above-given disadvantages.

Yet another object is the provision of such a printer which is easy to load, and which passes the form band along a path which is extremely direct from the holder where the supply is kept to the receptacle where the printed form is deposited.

These objects are attained according to the present invention in a printer for a data-processing machine having a single operator station which comprises a supply holder on the front of the machine next to the operator station for holding a form band, a support on the machine next to the station with an upwardly concave surface, a receptacle on the back of the machine below the support and guide means for passing the band up from the supply holder over the upwardly concave surface and down to the receptacle. Printing means including a vertically displaceable printer head above and displaceable horizontally along the upwardly convex surface can print on the band at this surface. Thus, in accordance with the present invention the form band is merely pulled up out of the front supply, over the upwardly convex printing surface and drops down to the receptacle for the printed form. A single reversal through 180 degrees is carried out and the path has the simple shape of an inverted U so that jamming of the band is almost impossible. Furthermore, the upwardly convex printing surface insures that the band will lie tightly against this surface and take a good impression from the printer head. Due to the short feed path, only one transport device, either a roller or a pin wheel tractor need engage the form band. Since the path that the form band follows is very simple, it is extremely easy to load the machine and, in case there is a paper jam, to find its cause and fix it.

In accordance with yet another feature of this invention there is provided next to the operator station at the printer a magnetic-card feeding device. Thus, a stack of magnetic cards may be fed from the front or the back of the machine and printed at the same time the form band is printed.

In accordance with yet another feature of this invention the form band is positively driven by one drive means only provided between the printing location and the filing receptacle. No other drive need be provided for the form band, at most only a paper brake between the supply holder and the printing location need be provided to hold the band down tight over the printing surface. In accordance with this invention there are guide means provided for guiding the form band from the supply holder to the printing location which guide means comprises a feed slot pivotal about a horizontal axis and normally extending vertically down from below the printing location towards the form supply. This guide means may be tilted up into a generally horizontal or even upwardly inclined position in order to facilitate loading of the machine. According to this invention means is provided for holding this guide means in the raised position and for disengaging from this slot any feelers or the like in it during the loading operation when it is in the raised position.

According to further features of this invention means is provided for signalling the operator of the machine when the form band in the supply has been depleted. Such a detector includes a feeler engageable against the paper and means for detecting the passage of the end of the form band past this feeler.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
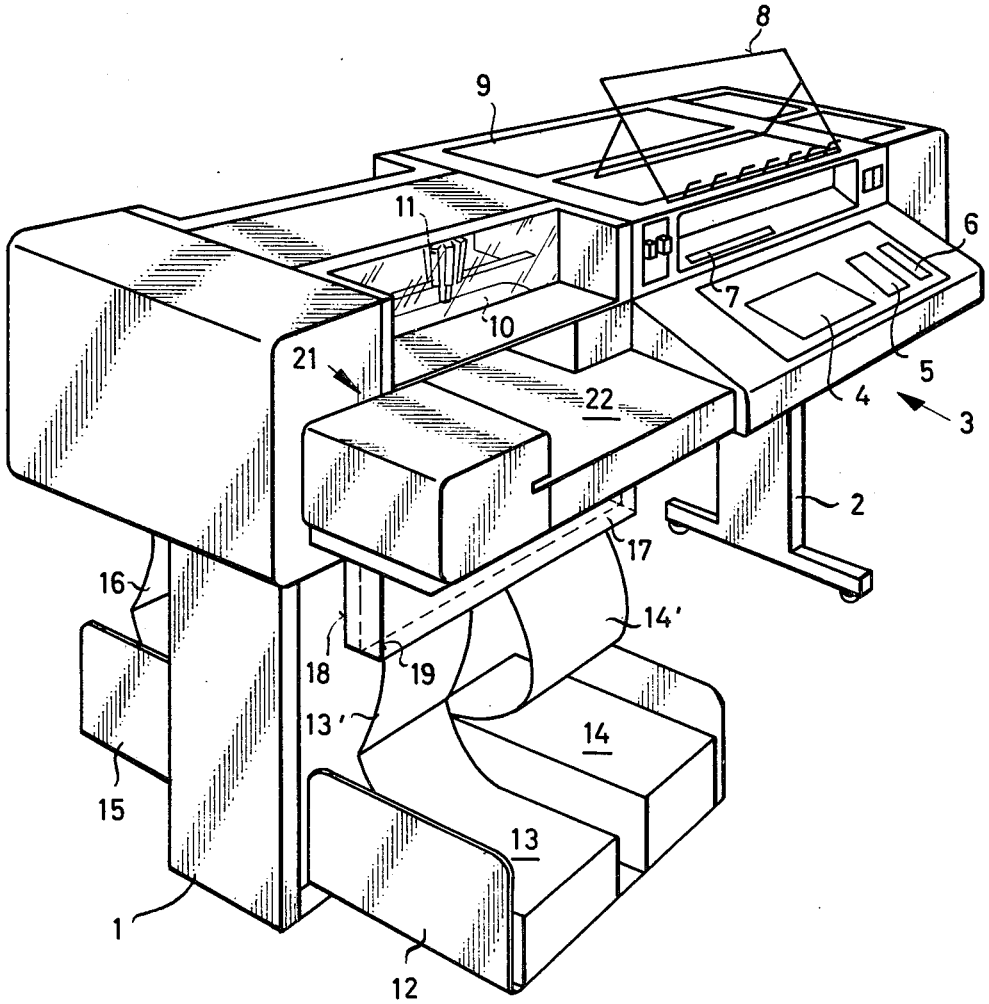
FIG. 1 is a perspective view of a data-processing machine according to this invention.

As is shown in FIG. 1, the data-processing machine according to this invention has a stand comprised by a left-hand foot 1 and a right-hand foot 2. An operator station 3 is provided with a standard typewriter-type alpha-numeric keyboard 4, a numerical calculator-type input 5, a function keyboard 6, and input control indicating means 7. The entries made on any of the keyboards 4 or 5 can be viewed continuously on the indicating means 7 and, if they are correct, an enter button can then be pressed to complete the entry. A clear plastic support 8 is provided on top of the machine for holding up the material from which the operator sitting at station 3 is working. The electronic elements, memories, and the like are housed in the back portion 9 of the machine behind the operator station 3.

Figure 2:
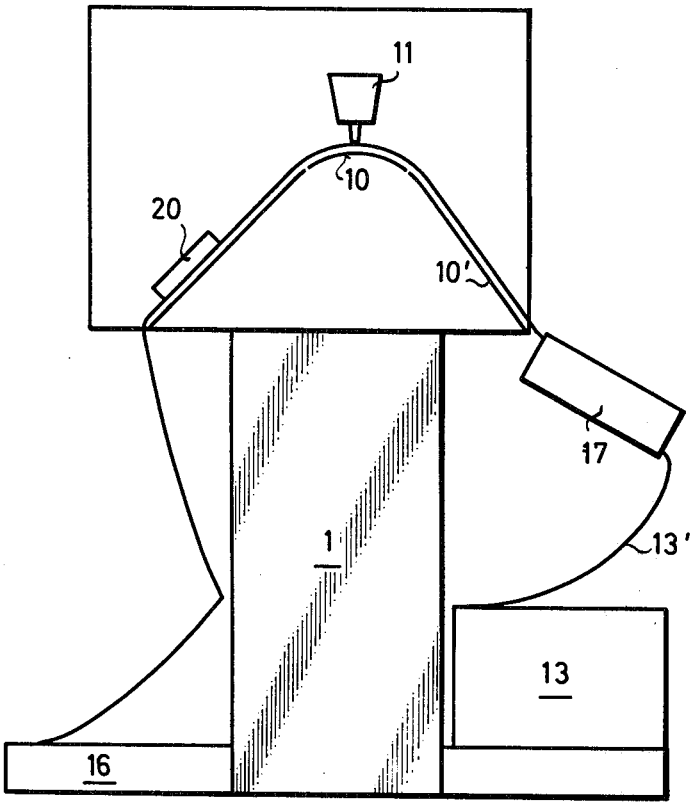
FIG. 2 is a side schematic view illustrating the paper path in the machine of FIG. 1.

With reference also to FIG. 2, the data-processing machine is shown to have adjacent to the station 3 an upwardly convex support 10' having an apex 10 constituting a printing location and over which is provided a printing head 11 displaceable longitudinally and horizontally along the printing location 10. The printing head 11 here is a needle-type printer, having an array of separately vertically displaceable needles which can form any of a multitude of letters, numerals, and signs. It is also possible to provide a ball-type printer. In any case, it is essential that the printing element of the head 11 be vertically displaceable into and out of contact with a paper sheet overlying the apex 10 of the guide surface 10'.

FIG. 1 further shows a supply holder 12 having a stack 13 and 14 of form bands 13' and 14'. In back of the machine a further holder or receptacle 15 is provided which receives a stack 16 of the same forms 13' and 14' after they have been printed on.

The bands 13' and 14' pass normally up through a vertically disposed slot 17 between the rear plate 18 and face plate 19 thereof. The two form bands 13' and 14' are fed up through the slot 17 and next to one another and do not overlap, even at the printing station 10. Nevertheless the single printer 11 can print on both of them. Downstream of the printer 11 over the surface 10 relative to the direction of displacement from the stack 13 to the stack 16 there is provided a drive 20 for the paper. Normally the bands 13' and 14' have perforated edges which can be engaged by pin wheel tractors of the drive 20. Two such tractors are provided for each form band.

As also shown in FIG. 1 it is possible to provide a magnetic-card feeding device 21 on the front of the printer half of the machine. Such cards may be fed horizontally from a support table 22 to the printing support 10 and then be picked up in a receptacle in the back of the device. The transport for the magnetic cards is completely independent of the drive 20 for the form bands so that these cards can be printed in conjunction with or instead of the form bands. Details of such magnetic card processing devices may be taken for instance from German Auslegeschrift No. 2 507 767.

Figure 3:
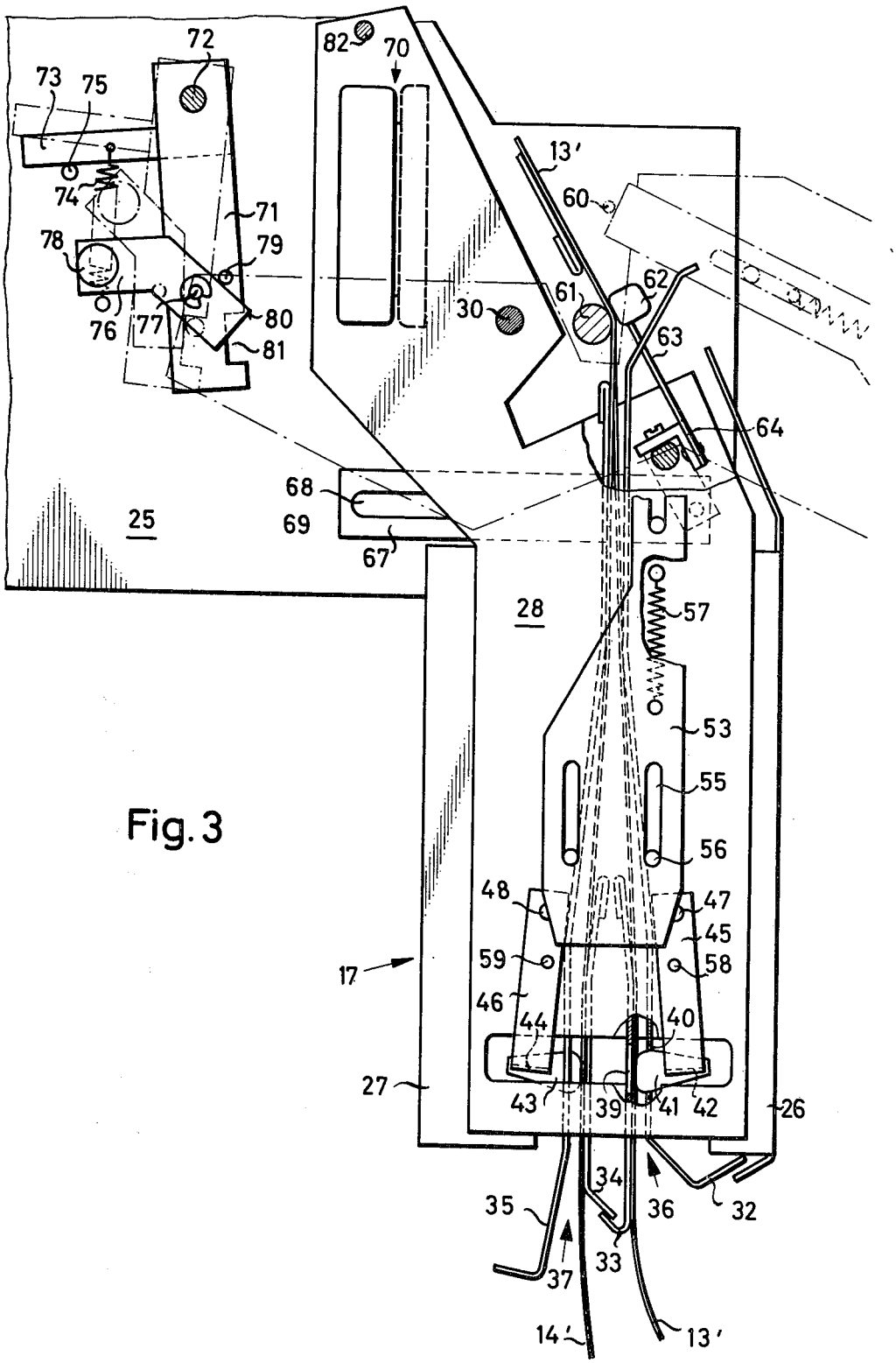
FIG. 3 is a side view partly in section showing the paper guide for the machine from the left-hand side of the machine.
Figure 4:
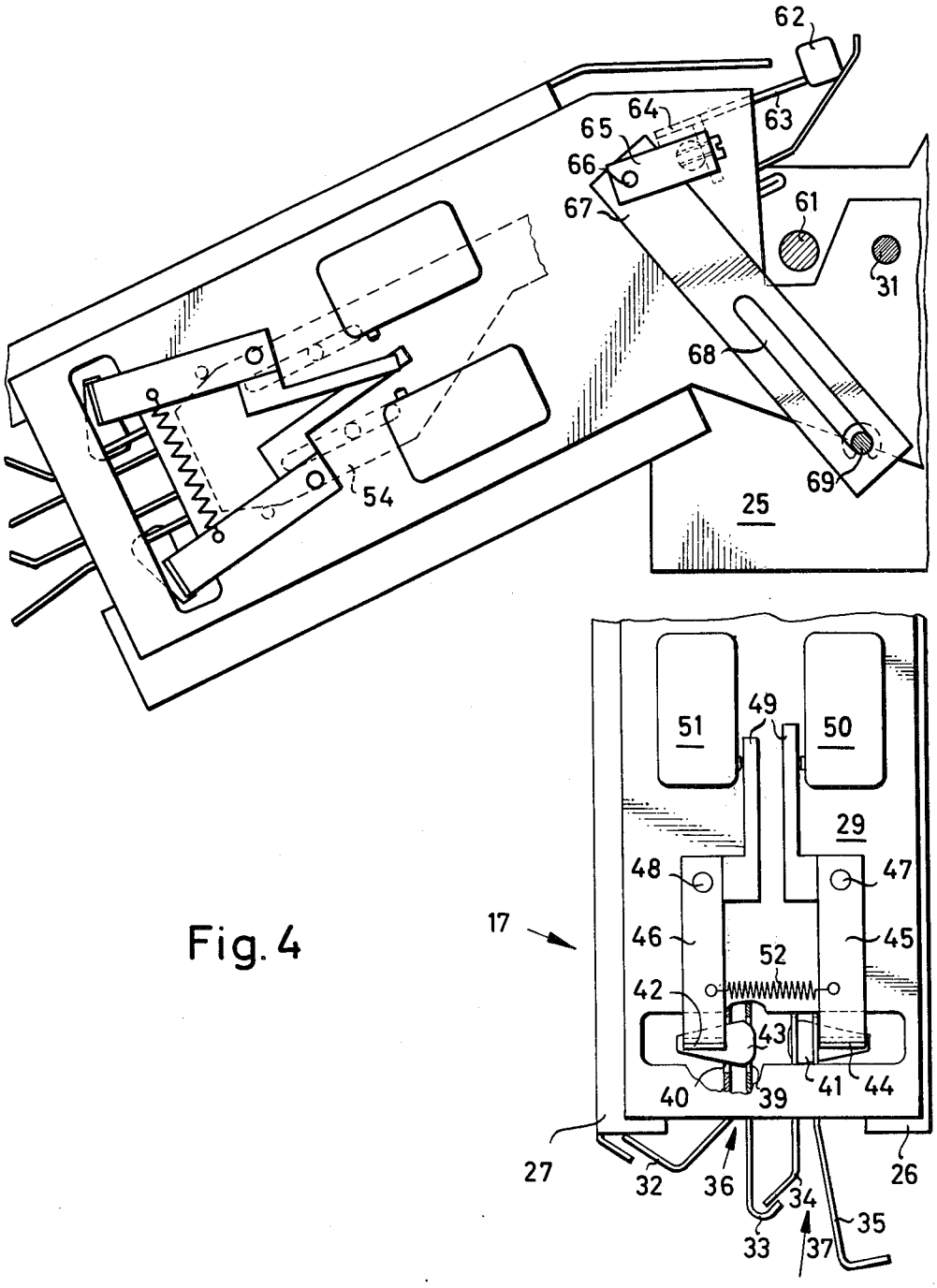
FIG. 4 is a similar side partly sectional view from the opposite side of the machine in accordance with this invention.

FIGS. 3 and 4 show the guide slot for the form bands 13' and 14' in more detail. In FIG. 3 the raised position is shown in dot-dash lines and in FIG. 4 the down position is shown in light solid lines whereas the up position is shown in heavy solid lines.

The data-processing machine comprises support plates 25 on which the guide slot 17 is pivotally mounted between a front cover 26 and a rear cover 27. End plates 28 and 29 are pivotal on the support plates 25 about coaxial pivot pins 30, 31 fixed on the data-processing machine. Four plates 32, 33, 34 and 35 define a pair of guide slots 36 and 37 adapted to respectively receive the bands 13' and 14'. The outer plate 32 and 35 of each slot 36 and 37 is formed with throughgoing hole 40 and the inner plate is formed with a throughgoing hole 39. Feelers 41 and 43 carried on horizontal bars 42 and 44 engage the form bands 13' and 14' through these holes 39 and 40. The bars 42 and 44 are carried on respective lever arms 45 and 46 pivoted at 47 and 48 on the end plates 28 and 29. Extensions 49 at the top of the levers 45 and 46 adjacent plate 29 are engageable with microswitches 50 and 51 connected to a signal device in the data-processing machine. A spring 52 engaged between each of the levers 45 and 46 tends to pull the feelers 41 and 43 toward one another and through the holes 39 and 40 as indicated in light solid lines in FIG. 4.

From the above described the following function of feelers 41 and 43 and switches 50, 51 may be derived. When the guide slot 17 is in its "down" position as shown in FIG. 3 and form bands 13' and 14' are available, switches 50, 51 are open, no signal is given. The same applies to that position of guide slot 17 as shown in heavy solid lines in FIG. 4 being the upturned position for introducing fresh form bands. However, when the guide slot 17 is in its "down" position as shown in light solid lines in FIG. 4 and the supply of form bands has run out the feelers 41 and 43 may enter the holes 39, 40, allowing the levers 45, 46 to swing so that switches 50, 51 are closed thereby operating the signalling device.

Each plate 29 and 28 carries a slider 53 and 54 each having three slots 55 serving as guide slots with respect to pins 56 attached to end plates 29, 28. A spring 57 on each slider 53 and 54 urges it up and away from the lower end of the guide slot 17. The levers 45 and 46 carry respective pins 58 and 59 engageable against oblique camming surfaces on the ends of the sliders 53 and 54. The upper end of each slider 53 and 54 is engageable against a pusher pin 60 fixed on the support plate 25. When the slot 17 is lifted from the solid-line position to the dot-dash line position of FIG. 3, the upper end of each slider 53 and 54 engages against the pin 60 and pushes the sliders 53 and 54 down, thereby forcing the ends of the sliders 53 and 54 between the pins 58 and 59 to cam levers 45, 46 apart and thereby feelers 41 and 43 out from the holes 39 and 40 in the plates 32 to 35 as indicated in FIG. 4 in heavy solid lines.

The form bands 13' and 14' are advanced, as described above, by means of the transport device 20 and are braked by means of an arrangement comprising braking elements 62 pressing the bands 13' and 14' against a smooth horizontal bar 61 lying at the upstream lower end of the support surface 10'. The braking elements 62 are carried on spring-steel arms 63 secured to a bracket 64 fixed to a horizontally pivotal rod carried in the end of a pair of arms 65 and journalled in the plates 28 and 29. The other ends of the arms 65 are secured by means of a pivot 66 to a link 67 formed with a longitudinally elongated slot 68 in which engages a pin 69 secured in the fixed mounting plates 25. Thus when the slot 17 is lifted the elements 62 are automatically pulled away from the rod 61 and allows the papers 13' and 14' to be fed through the slots 36 and 37.

The guide slot arrangement 17 is normally held in the position illustrated in solid lines in FIG. 3 by means of heavy magnets 70 partially arranged on plates 25, partially on plates 28, 29. When lifted by pivoting the two plates 28 and 29 about the axes 30 and 31 it can be locked in position. For this purpose a pair of lever arms 71 pivoted on horizontal pivots 72 and having backwardly extending arms 73 normally pulled down by springs 74 into engagement with abutment pins 75 is employed. Each such lever 71 carries a pawl 76 pivoted at 77 on the respective lever 71 and carrying a weight 78 so as normally to rest against an abutment pin 79 on the respective lever 71. The end 80 of pawl 76 opposite the weight 78 is engageable across a notch 81 formed in the respective lever 71.

When the slot arrangement 17 is tilted up into the dot-dash line position of FIG. 3 the pin 82 slides down the front surface of the lever 71, pivoting it clockwise and eventually pivoting the pawl 76 also clockwise and coming to rest in the upper end of the notch 81. In this position the slot arrangement 17 can be released and will not drop back down so that the user may feed a new sheet 13' into the slot 36 and a new sheet 14' into the slot 37. The operator has been informed that the supply has run out by closing of either the microswitches 50 or 51. Once the loading operation is completed the user need merely lift the slot 17 a little further so that the pin 82 moves into the bottom of slot 81. This allows the pawl 76 to pivot back into the solid-line position. Release of the slot arrangement 17 will cause the pin 82 to ride up in the notch and over the front end 80 of the pawl 76, free of the lever 71. The slot 17 will then be able to return to the solid-line position of FIG. 3 with the two magnets 70 holding it there.

It will be understood that each of the elements described above, or two or more together, may also find a useful application in other types of structures differing from the types described above.

While the invention has been illustrated and described as embodied in a data-processing machine, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A data-processing machine comprising:

a stand having a front side and a back side;

an operator station on said stand at said front side;

an input keyboard at said operator station;

data-processing hardware in said stand coupled to said keyboard;

a band supply holder on said front side next to said station for holding a form band;

a band support on said stand next to said station and above said band holder and having an upwardly convex surface;

a band receptacle on said back side of said stand below said band support;

guide means for transporting said band up from said supply holder over said surface and down to said band receptacle, said guide means having not more than a single transport device engaging said band, said transport device arranged between said surface and said receptacle, said guide means also including a guide slot between said surface and said holder and provided with means for braking said band as it is transported to said surface, said guide slot being displace-placeable between an upright working position directed downwardly at said band supply and a pivoted input position;

means for moving said means for braking out of engagement with said band when said slot is in said input position;

a card support on said front side of said stand next to said station and adjacent said band support for supporting a magnetic card;

feed means next to said station at said card support for feeding said card through said stand to said back side, whereby data can be entered on said cards; and printing means operable by said keyboard and by said hardware and including a horizontally displaceable printing head disposed above said support having vertically displaceable printing elements engageable vertically with a band guided over said support for printing on such band at said support.

2. The machine defined in claim 1, wherein said guide slot has a pair of slot-defining plates formed with aligned throughgoing holes, said machine further comprising means including a feeler element extendable through said holes for detecting the presence of paper in said slot and for generating an output when no such presence is detected.

3. The machine defined in claim 2, further comprising a spring engaging said feeler element and urging same into a position extending through said holes.

4. The machine defined in claim 3, further comprising means for withdrawing said feeler element from said position engaging through said holes on displacement of said slot into said input position.

5. The printer defined in claim 1 wherein said band supply holder is adapted to hold two such bands, said guide means having a separate guide slot for each of said bands.

6. The printer defined in claim 1 wherein said slot is provided with means for detecting the presence of paper in said slot and for generating an output when no such presence is detected.

7. The printer defined in claim 1 wherein said surface is shaped as an inverted U and said printing head is provided at the apex of said inverted U.

* * * * *